United States Patent [19]

Berthold

[11] Patent Number: 4,581,980

[45] Date of Patent: Apr. 15, 1986

[54] HYDROSTATIC AXIAL PISTON MACHINE WITH SWIVELLING INCLINED DISC

[75] Inventor: Heinz Berthold, Horb a.N., Fed. Rep. of Germany

[73] Assignee: Brueninghaus Hydraulik GmbH, Fed. Rep. of Germany

[21] Appl. No.: 728,751

[22] Filed: Apr. 30, 1985

[30] Foreign Application Priority Data

May 23, 1984 [DE] Fed. Rep. of Germany ..... 3419266
Aug. 2, 1984 [DE] Fed. Rep. of Germany ..... 3428591

[51] Int. Cl.[4] ..... F01B 13/04; F01B 3/00

[52] U.S. Cl. ..... 92/12.2; 92/57; 91/506

[58] Field of Search ..... 92/12.2, 57; 91/506, 91/473; 417/222

[56] References Cited

U.S. PATENT DOCUMENTS 2,379,546 7/1945 Snader et al. ..... 91/506
3,412,447 11/1968 Summerfield ..... 92/12.2

FOREIGN PATENT DOCUMENTS 1055959 4/1959 Fed. Rep. of Germany ..... 92/12.2
1653529 11/1973 Fed. Rep. of Germany .
603513 4/1960 Italy ..... 92/12.2
500299 2/1939 United Kingdom ..... 92/12.2

*Primary Examiner*—Paul E. Maslousky

*Attorney, Agent, or Firm*—Scully, Scott, Murphy & Presser

[57] ABSTRACT

The invention relates to a hydrostatic axial piston machine (1) having a cylinder drum (9), rotating in a housing, which cylinder drum receives pistons (12) arranged on a pitch circle, and having an inclined disc (16) which pivots, in a pivot, about a swivelling axis (21) which extends eccentrically to the pitch circle, which pivot is formed by at least one bearing (23) having a bearing surface (26) which is free in the direction of the pistons (12), the inclined disc (16) being arranged loosely between the bearing (23) and the pistons (12) and being pivotable by means of an adjusting member (28). The aim of the invention is to develop the axial piston machine so that, while ensuring a simple structural design sign and simple assembly and dismantling of the inclined disc (16) and of the adjusting member (28), defined limitation of the adjusting movement of the inclined disc (16) in the direction of zero position or minimum delivery is possible. This is achieved in that the adjusting member (28) is arranged on one side of a central axis and the swivelling axis is arranged on the opposite side of the central axis, and the adjusting member is located on the side of the disc which is remote from the pistons, and is guided in the end wall of the housing (2); and in that the adjusting movement of the inclined disc (16) is limited in the direction of the pistons (12) by a stop (31) which is arranged on the side of the inclined disc (16), relative to its swivelling axis (21), on which the adjusting member (28) also is disposed.

5 Claims, 2 Drawing Figures

HYDROSTATIC AXIAL PISTON MACHINE WITH SWIVELLING INCLINED DISC

TECHNICAL FIELD OF THE INVENTION

The invention relates to an axial piston machine in accordance with the precharacterising part of claim 1.

BRIEF DESCRIPTION OF THE PRIOR ART

An axial piston machine of this type is described and represented in GB-PS No. 866 661. In the known construction the adjusting member is formed by a hydraulic regulating piston which is arranged on the side of the inclined disc which faces the pistons and which acts upon the inclined disc offset to the side, relative to the axis of the cylinder drum, to which its swivelling axis also is offset relative to the axis of the cylinder drum. The regulating piston is disposed, in a radial manner, adjacent to the cylinder drum and is supported in a cylinder which projects inwards, in a radial direction, from the housing of the axial piston machine. The inclined disc has a projection which projects outwards, in a radial direction, and which is acted upon by the regulating piston.

There is no particular limitation for the adjusting movement of the inclined disc in the direction of zero or minimum delivery position.

The known development produces, on the one hand, a radially large construction and, on the other hand, difficult assembly and dismantling of the inclined disc and of the regulating piston. The large structural size is due to the fact that the regulating piston is arranged, in a radial manner, adjacent to the cylinder drum. Assembly and dismantling is therefore difficult because, for reasons of design, the cylinder receiving the regulating piston projects, by a considerable amount, into the free interior space of the housing and therefore not only does it complicate insertion and removal of the inclined disc into and out of the housing, but it also covers the connection point at which the regulating piston is connected with the inclined disc for the purpose of acting upon the same. A further disadvantage of the known development may be seen in the fact that this connection must not be made until the inclined disc has been inserted into the housing, which is difficult in view of the arrangement in question and in view of the restricted space conditions.

OBJECT OF THE INVENTION

The object underlying the invention is to develop an axial piston machine of the type described at the beginning, in such a way that, while ensuring that there is a simple structural design and simple assembly and disassembly of the inclined disc and of the actuator, there is defined limitation of the adjusting movement of the inclined disc in the direction of zero position or minimum delivery.

SUMMARY OF THE INVENTION

This object is achieved by means of the features contained in claim 1.

In the development according to the invention the adjusting member is arranged on the side of the inclined disc which is remote from the pistons, where it is in a position which does not impede assembly and disassembly of the inclined disc. The inclined disc can be removed and installed without the need for any removal or adjustment of the adjusting member. Simplification of the structural design is provided by the fact that the adjusting member can be arranged in the position according to the invention with considerably more ease than in the case of the known development. This is significant especially with regard to the guide surfaces for the adjusting member, which, in the development according to the invention not only clearly limits, in a simple manner the swivelling movement of the inclined disc in the direction of zero position or minimum delivery, by means of a stop, but the inclined disc is fixed in the stop position between the adjusting member and the stop.

In contrast to the known development, the development according to the invention produces a compact construction. The housing does not need to be any larger, in a radial direction, than is necessary to receive the cylinder drum. The axial enlargement of the housing, which is due to the adjusting member being supported, according to the invention, in the end wall of the housing, is insignificant.

The features contained in claims 2 and 3 produce developments which are simple and practical. The development according to claim 3 facilitates assembly and disassembly, as the stop can be brought into the working position after the inclined disc has been assembled. A further advantage consists in the fact that adjustable stops can be put into practice, for example by the screw or a rotating cam having eccentric stop faces, or by the screw having a conical stop section, or by an oblique arrangement of the screw, so that axial displacement of the screw relative to the axial piston machine is possible.

The construction according to claim 4 produces a simple development of the adjusting device comprising the adjusting member, and is intended for such cases where only two delivery settings are desired. In a case such as this, the adjusting member does not need to be stopped in its intermediate positions.

The development according to claim 5 ensures that the inclined disc is always loaded with a turning moment which acts against the adjusting member. As a result, an adjusting member which acts only on one side, e.g. a unilaterally acting hydraulic piston, can be used. Neither is there any need for a mechanical connection, in the usual sense, between the inclined disc and the adjusting member, rather the latter is simply required to press against the surface of the inclined disc. The restoring movement of the adjusting member is constrained in each case by the turning moment described above.

BRIEF DESCRIPTION OF THE DRAWINGS

An exemplary embodiment of the invention is hereinafter described in greater detail, with reference to a drawing.

DETAILED DESCRIPTION OF A PREFERRED EMBODIMENT OF THE INVENTION

Figure 1:
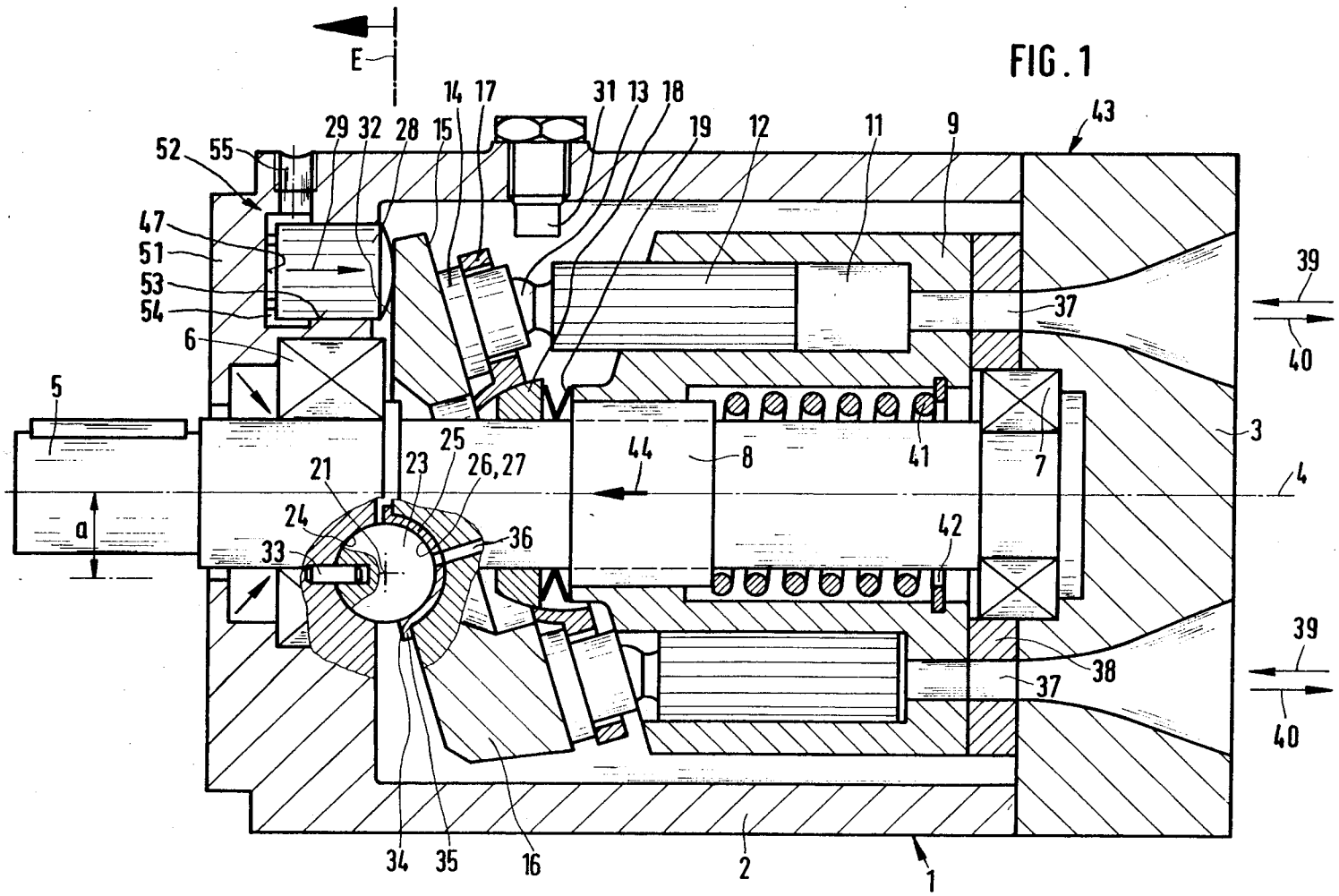
FIG. 1 shows a longitudinal section through an axial piston machine according to the invention.

The axial piston machine, denoted generally with 1 in FIG. 1, has a two-part housing, comprising a cupshaped housing part 2 and a housing cover 3, in which there is supported, in roller bearings 6, 7, a drive shaft 5 which extends along a center line or central axis 4. There is supported on the drive shaft 5, on a multi-wedge section designated 8, a cylinder drum 9 which has, distributed uniformly over a pitch circle, a plurality of cylinder bores 11 which receive pistons 12. The pistons 12 have spherical heads 13 which catch behind sliding blocks 14 which rest against the sliding surface 15 of an inclined disc 16. The installation on the sliding surface 15 is effected by a retaining plate 17 which, in the present exemplary embodiment, is mounted through a spherically shaped recess on a spherically shaped carrier piece 18 in the form of a spherical head. The carrier piece 18 is longitudinally displaceable on the drive shaft 5 and is loaded, in the direction of the inclined disc 16, by means of a pressure spring 19, represented in outline, which is braced against the cylinder drum 9.

The inclined disc 16 pivots, in a pivot bearing, about a pivot axis 21 which is formed by two bearings, lying in succession along the swivelling axis 21 and designated generally 22, which comprise two spheres 23 supported in spherical recesses 24 in the cup-shaped housing part 2 and in spherical recesses 25 in the inclined disc 16. The surfaces of the spheres 23 which face the pistons, and the spherical surfaces of the recesses 25 in the inclined disc 16 therefore form the bearing surfaces 26, 27 on the housing side and on the inclined disc side.

Adjustment of the inclined disc 16 takes place by means of a hydraulic piston 28 which is displaceably guided in parallel with the drive shaft 5, in the flanged portion of the cup-shaped housing part 2, and which can be moved out hydraulically in the direction of the arrow 29. In the position shown, the inclined disc 16 is in its maximum piston stroke position. By moving out the hydraulic piston 28, the inclined disc 16 can be adjusted about the swivelling axis 21 until it encounters a stop 31 which is formed by a threaded screw which is screwed into the housing 2 at the side. In the stop position, the axial piston machine is set at minimum piston stroke. In order to make possible the inclined position shown, the inclined disc 16 is bevelled on its side facing the bearings 22. This inclined surface is denoted with 32.

The bearings 22 and the piston 28 represent three support points (see FIG. 2) which define a support plane E which, in the position shown in FIG. 1, is substantially at right angles with the drive shaft 5. The spheres 23 are secured against turning about the swivelling axis 21, by means of pins 33 which engage therein and in the housing part 2. The spherical recesses 25 in the inclined disc 16 are incorporated in spherical bushings 34 which rest with a collar 35 against the side of the inclined disc 16 which faces the bearings 22.

The bearings 22 are connected, by means of lines 36, with the oil carrying system of the axial piston machine 1 and are therefore oil-lubricated.

The function of the pressure springs 19 is to maintain contact pressure between the inclined disc 26 and the bearings 22. The same function could be achieved, in an advantageous manner, by means of pressure springs which could be arranged in the cylinder bores 11 and act upon the pistons 12 in the direction of the inclined disc 16.

During operation, the cylinder drum 9 is set in rotation by the drive shaft 5. The cylinder bores 11 communicate alternately with circumferential kidney-shaped control openings 37, in a control plate 38, of which one is connected with a supply line and the other is connected with an outlet line for the hydraulic medium. The direction of flow of the hydraulic medium is characterised by the arrow 39 for pump operation and by the arrow 40 for motor operation. Sealing between the cylinder drum 9 and the control plate 38 is ensured by a pressure spring 41 which is supported against the drive shaft 5 and which loads the cylinder drum 9, against the control plate 38. The pressure spring 41 acts upon an inner ring 42. An advantageous embodiment also consists in at the same time loading the inclined disc 16 also, directly, or indirectly by means of the pressure spring 41, against the bearings 22. As a result, the pressure spring 19 would be omitted. The pressure spring 41 can act against the carrier piece 18.

The swivelling axis 21 is at a distance a from the effective line of the piston force 44 resulting from the forces of the active pistons 12. The swivelling axis 21 is offset to the side which is remote from the piston 28, to the resultant piston force 44. The distance a is approximately 16 mm. The resultant piston force 44 is produced by the pistons 12 on the pressure side 43. Due to the distance a, the inclined disc 16 is loaded with a turning moment in an anticlockwise direction. This ensures that the inclined disc 16 rests against the piston 28 functioning as adjusting member.

Figure 2:
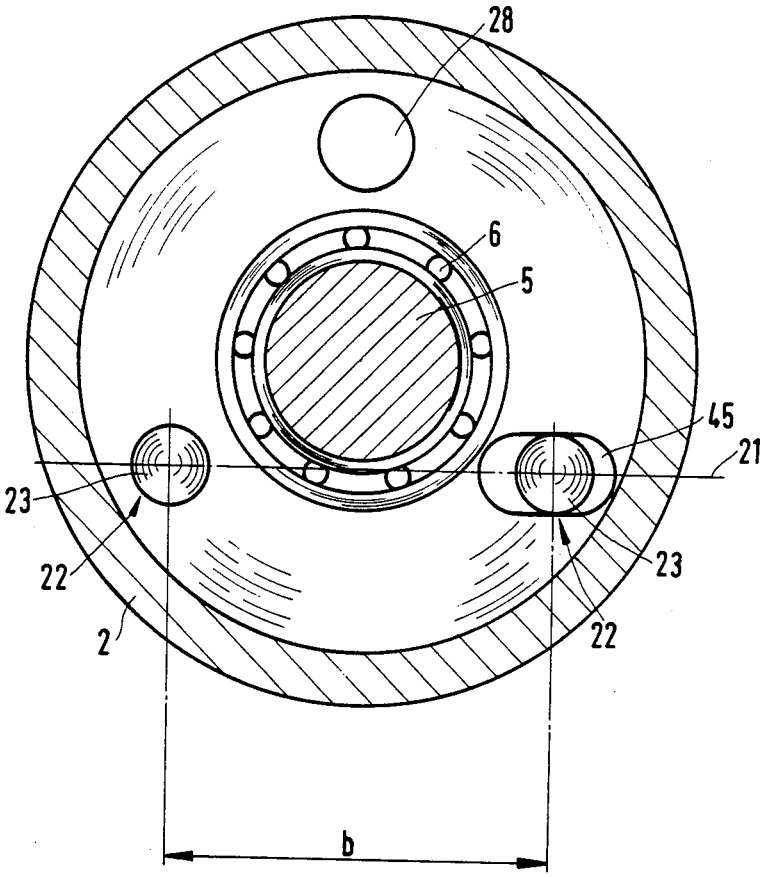
FIG. 2 shows a section along the line E in FIG. 1.

Precise conformity of the distance, denoted with b in FIG. 2, between the bearings 22 with the same distance between the recesses 25 in the inclined disc 16 is necessary. As, for technical manufacturing reasons, precise conformity is obtainable only at great expense, in order to avoid this expense, a bearing 22 can be developed as a so-called movable bearing, as represented in FIG. 2. The right sphere 23 in FIG. 2 is received in a preferably round, longitudinal groove 45 which extends towards the left sphere 23. The right sphere 23 is therefore held so that it moves along the swivelling axis 21, as a result of which slight dimensional tolerances in the distance b are harmless.

Assembly and disassembly of the inclined disc is very simple, as it can be inserted, both by itself and already assembled on the drive shaft 5, from the open side into the housing part 2 and can also be removed again in the opposite direction.

A preferred embodiment of the axial piston machine 1 consists in that there is only single-stage adjustment of its swept volume. That is to say, it limits the possibility of adjustment to minimum and maximum swept volume. An on-off valve (not shown) is used for this, by means of which the piston 28 may be displaced either into its right end stroke position, in which the inclined disc 16 rests against the stop 31 (minimum swept volume), or into its left end stroke position, in which it rests against a stop surface 47 on the housing side 8 (maximum swept volume).

In order for the piston 28 to be acted upon hydraulically, the flanged portion, denoted with 51, of the housing 2 is developed in the manner of a cylinder, denoted generally with 52, which has a cylinder bore 53 and a working space 54. The working space 54 communicates, by means of a connecting bore 55, with a hydraulic control line (not shown) which can be connected with the connecting bore 55.

What is claimed is:

1. A hydrostatic axial piston machine having a rotating cylinder drum which is arranged in a housing and which receives pistons arranged on a pitch circle, said drum having a central axis, and said machine having an inclined disc which pivots, in a pivot, about a swivelling axis which extends eccentrically to the pitch circle, which pivot is formed by at least one bearing having a bearing surface which is free in the direction of the pistons, said swivelling axis being closer to the central axis than an end of the inclined disc, the inclined disc being arranged loosely between the bearing and the pistons and being pivotable by an adjusting member, characterised in that the adjusting member is arranged on one side of the central axis and the swiveling axis is arranged on the opposite side of the central axis, and the adjusting member is located on the side of the disc which is remote from the pistons, and is guided in an end wall of the housing; and in that the adjusting movement of the inclined disc is limited in the direction of the pistons by a stop which is arranged on the side of the inclined disc, relative to its swivelling axis, on which the adjusting member also is disposed.

2. An axial piston machine according to claim 1, characterised in that the stop is formed by a cam which projects from the housing into the movement space of the inclined disc.

3. An axial piston machine according to claim 2, characterised in that the cam can be inserted from the outside and, preferably, is formed by a screw.

4. An axial piston machine according to claim 1, characterised in that there is only single-stage adjustment of the inclined disc between minimum and maximum delivery.

5. An axial piston machine according to one of claims 1, characterised in that the swivelling axis is arranged at a distance (a) from said central axis offset to the side which is remote from the adjusting member.

* * * * *